United States Patent [19]

Sokol et al.

[11] Patent Number: 4,775,867

[45] Date of Patent: Oct. 4, 1988

[54] VIBRATION ISOLATION ENCLOSURE FOR HORN ANTENNA

[75] Inventors: David G. Sokol, Auburn; William E. Midden, Springfield, both of Ill.

[73] Assignee: Dickey-john Corporation, Auburn, Ill.

[21] Appl. No.: 753,188

[22] Filed: Jul. 9, 1985

[51] Int. Cl.[4] ..... H01Q 1/20; H01Q 13/02

[52] U.S. Cl. ..... 343/786; 343/DIG. 1; 343/713

[58] Field of Search ..... 343/786, DIG. 1, 784, 343/872, 705, 708, 713, 753; 342/109, 115, 117, 104

[56] References Cited

U.S. PATENT DOCUMENTS

| | | | |
|---|---|---|---|
| 3,053,980 | 9/1962 | Schmidt . | |
| 3,833,906 | 9/1974 | Augustine | 343/753 X |
| 3,859,660 | 1/1975 | Augustine et al. | 342/117 X |
| 3,895,384 | 7/1975 | Fathauer et al. | 342/109 |
| 4,030,097 | 6/1977 | Gedeon | 342/115 |
| 4,318,103 | 3/1982 | Roettele et al. | 343/753 X |
| 4,517,566 | 5/1985 | Bryant et al. | 342/117 |

FOREIGN PATENT DOCUMENTS

| | | | |
|---|---|---|---|
| 0123870 | 7/1984 | European Pat. Off. . | |
| 2222952 | 8/1979 | Fed. Rep. of Germany | 343/784 |
| 1293881 | 10/1972 | United Kingdom | 342/109 |

OTHER PUBLICATIONS

Sokol, David G., "Next Generation Radar Sensor for True Ground Speed Measurements", pp. 76–84.

*Primary Examiner*—Eugene R. LaRoche
*Assistant Examiner*—Benny T. Lee
*Attorney, Agent, or Firm*—Trexler, Bushnell, Giangiorgi & Blackstone, Ltd.

[57] ABSTRACT

A vibration isolation and EMI/RFI shielded enclosure for a horn antenna comprises an elongate hollow housing of sufficient dimensions to receive the horn antenna therewithin. Respective front and rear vibration isolation mounting assemblies have inner mounting portions coupled with the horn antenna and outer mounting portions coupled with the housing and resilient vibration damping members coupled intermediate the inner and outer mounting portions. Preferably, an EMI/RFI shielded enclosure is also provided for enclosing electrical circuits associated with the horn antenna.

21 Claims, 5 Drawing Sheets

70
70a
72
72
140
142
144
146
152
152
153
160
160a
162
164
166
168
174
180
182
182
184
186
187
188

VIBRATION ISOLATION ENCLOSURE FOR HORN ANTENNA

BACKGROUND OF THE INVENTION

The invention is concerned with the mounting of a horn antenna of a Doppler radar apparatus, and more particularly with a novel vibration isolation enclosure which isolates the horn antenna both from externally generated physical vibrations, as well as preferably providing electromagnetic interference/radio frequency interference (EMI/RFI) shielding for a radar transceiver unit and/or other electrical or electronic circuit elements associated with the horn antenna.

While the vibration isolation enclosure in accordance with the invention may find utility in a variety of applications, the description will be facilitated by reference to the specific problem of providing a vibration isolation enclosure for a horn antenna used in a Doppler radar for measuring the rate of travel of a vehicle. More particularly, velocity measuring apparatus for both over-the-road and off-road vehicles are utilized to measure and indicate the cumulative distance traveled as well as the rate of travel or velocity. Especially in off-road vehicles such as farm tractors, construction equipment, or the like, the terrains traveled are rough and uneven, and often the driving wheels of the vehicle experience considerable slippage relative to the ground.

Accordingly, conventional mechanical rotating speedometers, odometers or the like coupled to gearing or other mechanisms associated with the wheels do not necessarily provide accurate measurements of the actual velocity of, or of the distance traveled by, the vehicle relative to the surface over which it is traveling. Such measurements may be used not only for display but also for controlling other apparatus such as material spreader or spray apparatus pulled by or mounted to the vehicle. Such apparatus often require a velocity signal for accurate control of the rate of material or spray distribution thereby.

It has been proposed to utilize Doppler radar apparatus in connection with such off-road vehicles in an effort to avoid the problems associated with uneven terrain and wheel slippage. One such radar apparatus is disclosed for example in U.S. Pat. No. 3,895,384, which is commonly assigned with this application. The foregoing patent discloses directing the Doppler or radar horn antenna at a preferred angle of about 45 degrees relative to the ground, in order to provide optimum results. However, due to the uneven nature of the terrain traveled by such off-road vehicles, it will be appreciated that the Doppler signal provided by the Doppler radar unit will include some component or portion representing multidirectional vibration of the radar unit mounted to the vehicle. It will be appreciated that only the velocity or speed of the vehicle along the ground surface is desired. This is important for accurately determining the net or cumulative distance traveled from time to time by the vehicle over the ground surface. Accordingly, it is desirable to eliminate such other components from the final measurement or determination, if possible.

The foregoing vibration problem causes variations in the Doppler signal corresponding to the vibrations of the radar horn antenna mounted on the vehicle as the vehicle travels along the rough, uneven ground surface. It will be appreciated that with relatively large off-road vehicles on relative rough terrain, multidirectional vibrations can be considerable and these vibrations may readily be transmitted to the horn antenna mounted to a vehicle frame or the like. It will be appreciated that vibration-induced movements of the horn antenna will cause some additional, corresponding small change in the Doppler frequency or signal produced thereby. This vibration-induced component of the Doppler signal will be unrelated to the actual linear or horizontal velocity of the vehicle, and hence comprises an undesirable signal component.

Various improved signal processing systems have been proposed to improve the quality of the Doppler signal produced under such conditions, prior to utilization thereof for display or control of other equipment. One such signal processing system is shown in U.S. Pat. No. Re. 31,851, also assigned to the assignee of record herein.

Additional undesirable signal components may be induced in the related transceiver or other electronic circuits by electromagnetic interference or radio frequency interference (EMI or RFI). Such EMI/RFI induced signal components also bear no relation to the desired linear or horizontal velocity of the vehicle, and hence should be eliminated insofar as possible. In the case of relatively large off-road or farm vehicles, a number of large, rotating metallic parts of the vehicle, or of related machinery being pulled by or mounted to the vehicle may emit considerable electromagnetic interference signals. Accordingly, it is desirable to prevent such extraneous EMI/RFI signals from reaching the transceiver or other electronic circuits associated with the radar unit where they may induce or appear as extraneous noise signals.

While the Doppler radar and signal processing apparatus in accordance with the above-referenced U.S. patents have found widespread commercial success, there is room for yet further improvement. In this regard, the present invention proposes a vibration isolation enclosure for mounting a horn antenna to the vehicle while substantially isolating the horn antenna from vibrations produced or experienced by the vehicle. In this way, the Doppler signal produced by the horn antenna and associated transceiver can be kept substantially free of signal components due to such vibration. Accordingly, the velocity of the vehicle, which it is desired to monitor can be more accurately measured. In accordance with another aspect of the invention, the vibration isolation enclosure also includes an EMI/RFI shielded enclosure portion for mounting or enclosing the transceiver and other electrical or electronic circuits associated with the horn antenna.

OBJECTS AND SUMMARY OF THE INVENTION

Accordingly, it is a general object of the invention to provide a novel and improved vibration isolation enclosure for a horn antenna.

A more particular object is to provide a vibration isolation enclosure for a horn antenna which includes a protective housing and vibration damping means mounting the horn within the housing for opposing the transmission of vibrational forces in both axial and radial directions between the housing and the horn antenna.

A related object is to provide a vibration isolation enclosure in accordance with the foregoing objects which further includes EMI/RFI shielded enclosures for a Doppler transceiver and other circuit components operatively associated with the horn antenna.

Briefly, and in accordance with the foregoing objects, a vibration isolation enclosure for a horn antenna comprises an elongate hollow housing of sufficient dimensions to receive said horn antenna therewithin; respective front and rear vibration isolation mounting assemblies having inner mounting portions coupled with said horn antenna and outer mounting portions coupled with said housing and resilient vibration damping members coupled intermediate said inner and outer mounting portions. In accordance with a preferred form of the invention, there is further provided means defining an EMI/RFI shielded enclosure for enclosing circuit means associated with said horn antenna.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

FIG. 1 is a plan view of a fully assembled horn antenna unit or radar assembly utilizing vibration isolation and EMI/RFI shielded enclosures in accordance with the invention and assembled with a mounting surface of a vehicle or the like;

DETAILED DESCRIPTION OF THE ILLUSTRATED EMBODIMENT

Figure 1:
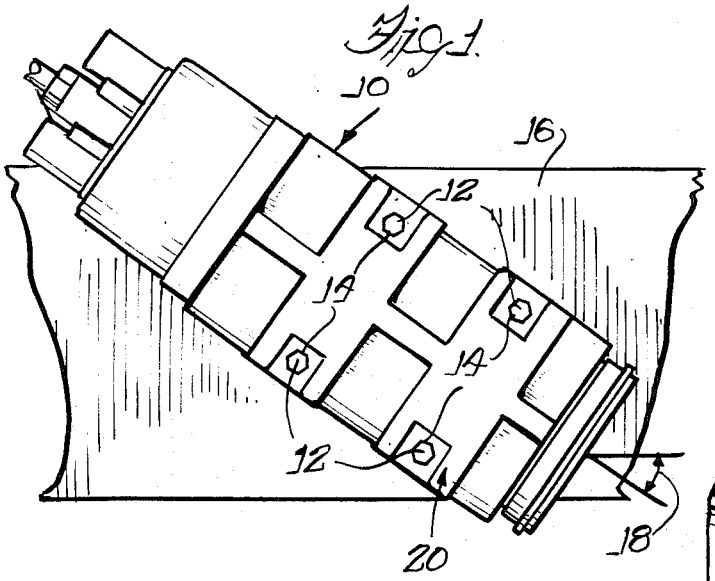

Referring now to the drawings, and initially to FIGS. 1 through 6, a vibration isolation enclosure for a horn antenna is indicated generally by reference numeral 10. As illustrated in FIG. 1, this enclosure, when fully assembled is generally rectangular in form and has defined therein a number of through bores 12 suitable for receiving elongate threaded fasteners 14 or other suitable means to fasten the enclosure 10 to a bulkhead or other surface 16 of a vehicle. In FIG. 1, this bulkhead or surface 16 is shown as a generally vertical surface, but as will be seen presently, the housing 10 may also be mounted to horizontal or other-oriented surfaces. Accordingly, the enclosure 10 is preferably oriented by fasteners 14 to point generally downwardly at a predetermined angle relative to the ground surface over which the vehicle travels. Preferably, this mounting is such that the angle between an axis of the housing, and hence of the radar horn mounted within the housing, as will presently be described, and a horizontal reference plane is substantially on the order of 35 degrees. This angle of substantially 35 degrees is indicated generally by reference numeral 18 in FIG. 1. It will be understood that the surface 16 may comprise any convenient mounting surface on a vehicle, or alternatively may comprise a suitable mounting bracket or the like affixed by other means (not shown) to some suitable mounting surface of the vehicle.

Figure 2:
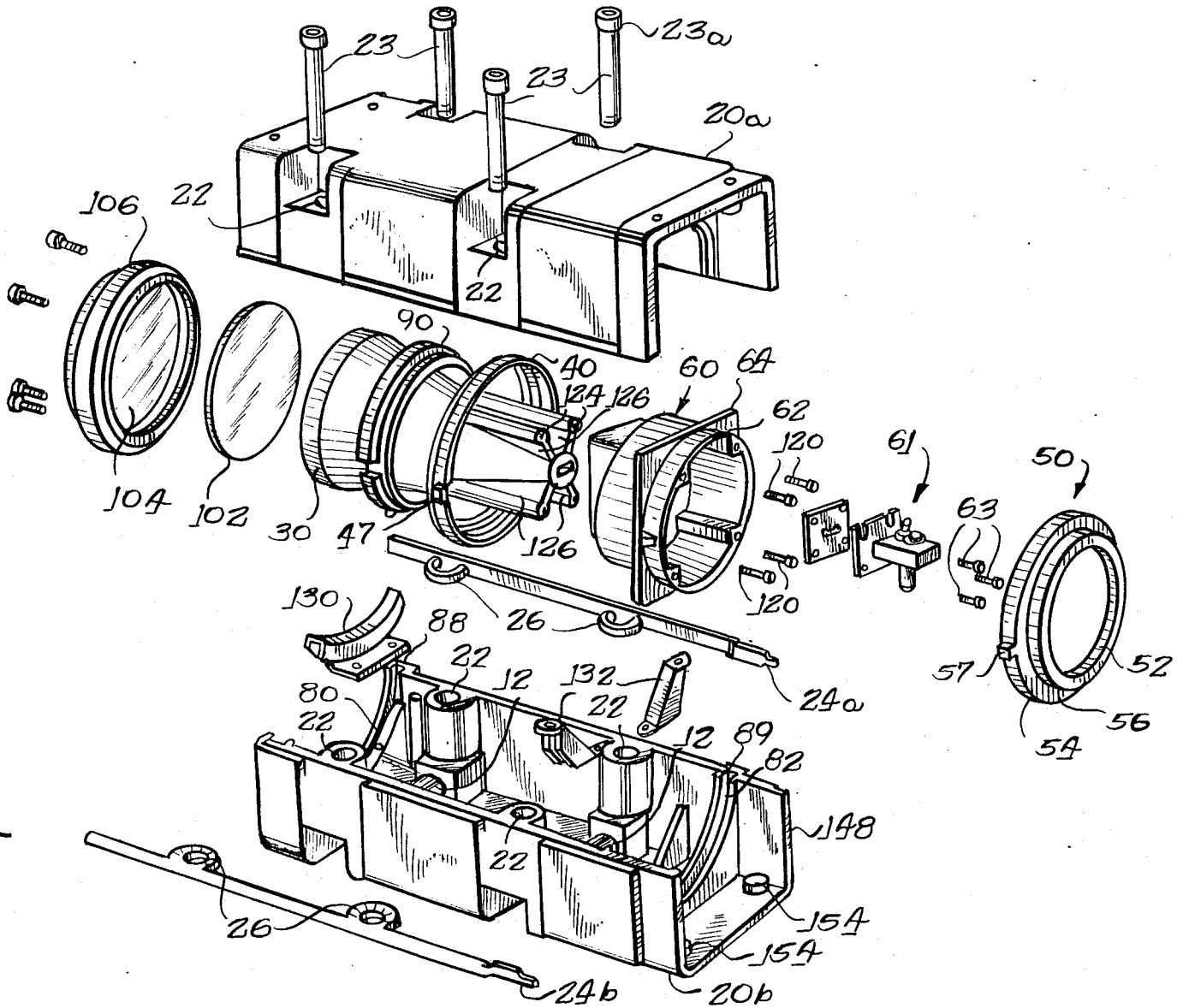
FIG. 2 is an exploded perspective view of a first portion of the radar unit assembly of FIG. 1.

Referring also to FIG. 2, it will be seen that the enclosure 10 includes an elongate housing 20 which in the illustrated embodiment comprises a pair of substantially identical housing halves 20*a* and 20*b*. The through bores 12 described with reference to FIG. 1 will be seen to extend generally horizontally across surfaces of both upper and lower housing halves 20*a* and 20*b*. Moreover, a second set of similar through bores 22 are formed generally at right angles to these bores 12 and similarly extend through both housing halves 20*a* and 20*b*. These additional through bores 22 may receive similar fasteners 14 so as to mount the housing alternatively from a generally horizontally extending surface, such as of a suitable mounting bracket or the like affixed to the vehicle. In this regard, the housing may also be mounted by means of bores 22 to any suitable vehicle surface, utilizing some suitable further bracket or other orienting means to achieve the substantially 35-degree angle 18 mentioned above.

The housing halves 20*a* and 22*a* are preferably held together by four elongate, hollow, rivet-like members 23 which extend through the bores or through apertures 22 and have enlarged head portions 23*a* at one end thereof and are preferably deformed over at the other end thereof to engage the housing halves securely therebetween. These hollow rivet-like members accept suitable elongate screws, bolts or other fastening members therethrough for coupling the housing to a bracket or other mounting surface.

In the illustrated embodiment, environmental sealing between the housing halves 20*a* and 20*b* may be provided by a pair of elongate gaskets 24*a*, 24*b* interposed between the housing halves on assembly thereof. These gaskets 24*a* and 24*b* include generally circular portions 26 to be interposed intermediate the respective portions defining the bores 22 in each of the housing halves 20*a* and 20*b*.

The elongate hollow housing 20 is of sufficient interior dimensions to receive a horn antenna 30 mounted therein. In the illustrated embodiment the horn antenna is a conical antenna, although other antennas may be mounted by the housing of the invention without departing from the principles of the invention. In accordance with the invention, respective front and rear vibration isolation mounting assemblies, indicated generally by reference numerals 40 and 50, are utilized for mounting the horn antenna within the housing. In the preferred embodiment illustrated, the mounting assemblies comprise substantially identical vibration isolation mounting rings. Each of these mounting rings includes an inner mounting portion 52 to be coupled with the horn antenna, an outer mounting portion 54 to be coupled with the housing and a resilient vibration damping member or portion 56 coupled intermediate the inner and outer mounting portions.

In accordance with the preferred form of the invention illustrated, EMI/RFI shielded enclosure means are provided for enclosing circuit means associated with the horn antenna. In this regard, these shielded enclosures include a first enclosure or transceiver housing 60 which houses a transceiver component 61 (See FIG. 8) mounted thereto by screws 63 for example. Also, a further shielded enclosure or housing member 70 (See FIG. 3) is provided which houses or encloses additional electrical or electronic circuits 72.

Referring now to the vibration isolation mounting assemblies or rings 40, 50 the mounting of the horn antenna 30 relative to housing 20 will be further described with reference also to FIGS. 4 through 6. As previously mentioned, these mounting means 40 and 50 are substantially identical vibration isolation mounting rings. Moreover, the cooperating structure in the housing 20 receiving these mounting rings is substantially identical at either axial end thereof, whereby only one such ring and the associated housing mounting structure need be described in detail.

Figure 4:
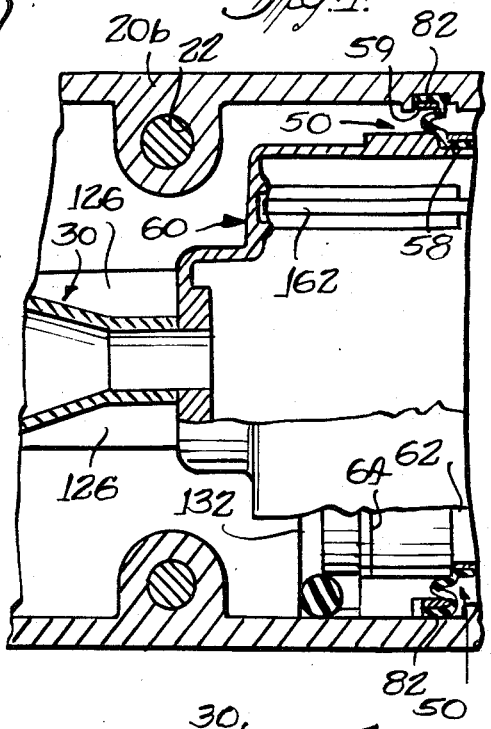
FIG. 4 is an enlarged partial sectional view illustrating vibration isolation mounting of a rear portion of the assembly of FIG. 1.
Figure 5:
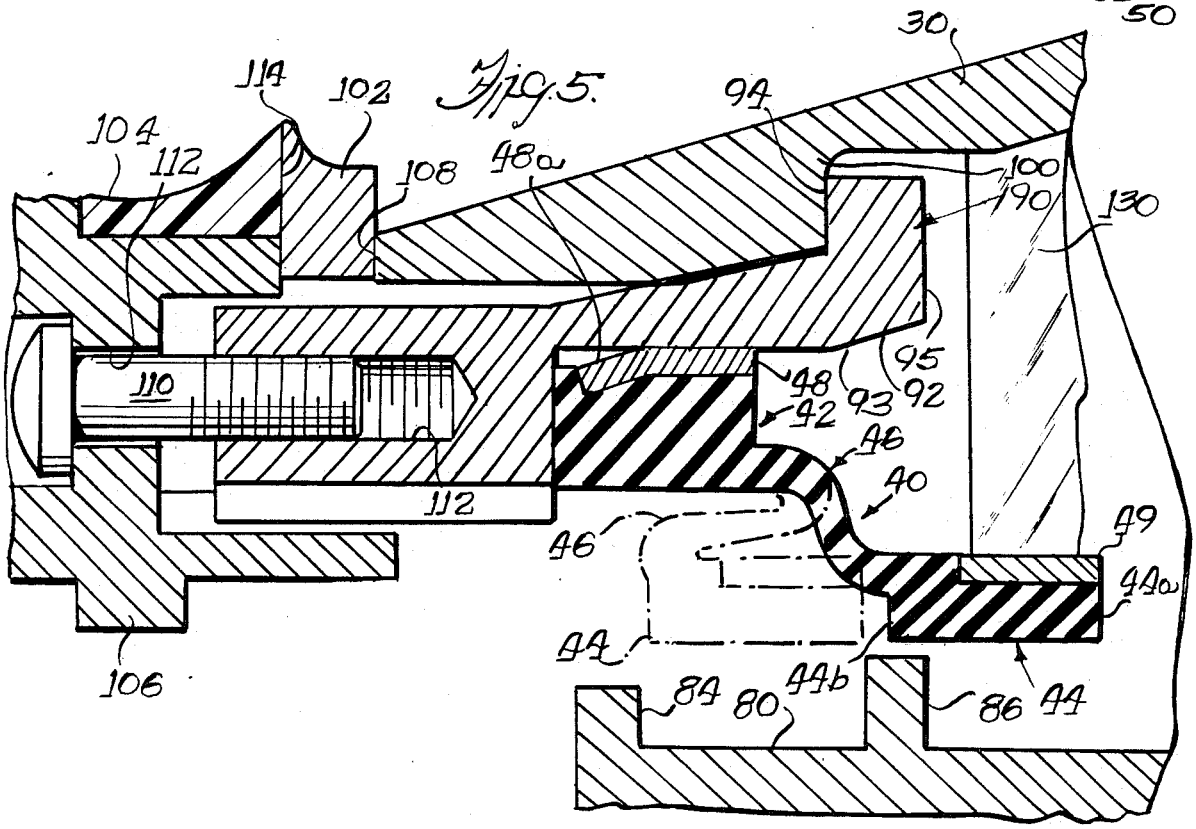
FIG. 5 is a further enlarged partial sectional view illustrating vibration isolation mounting of a front portion of the assembly of FIG. 1.

Referring more particularly to FIG. 5, as mentioned, the isolation mounting ring 40 includes a generally annular radially inner mounting portion 42 and a generally annular radially outer mounting portion 44. A resilient vibration damping means or portion comprising a flexible member or portion 46 joins these inner and outer mounting portions 42 and 44. Preferably, when the mounting ring 40 is an initial or undeformed condition, it takes the form (in cross-section) generally shown in solid line in FIG. 5. It will be seen that the inner and outer mounting portions 42 and 44 are held at an initial axial offset, with the flexible, joining portion 46 having a generally shallow, S-shaped appearance in cross-section. Referring also to FIGS. 2 and 4, it will also be seen that the front and rear vibration isolation mounting rings 40 and 50 are oriented in generally oppositely facing directions. That is, the inner mounting portions thereof are axially offset in generally oppositely facing axially outward directions relative to the radially outer mounting portions thereof.

These inner mounting portions are initially assembled with front and rear portions of the horn antenna in a manner which will be more fully described hereinbelow. Thereupon, the outer mounting portions 44 and 54 are deflected or moved respectively oppositely axially outwardly to engage a pair of similar, axially spaced mounting channels 80, 82 formed in the housing 20. In this regard, complementary halves of these channels 80, 82 are formed in each of upper and lower housing halves 20*a*, 20*b*. The axial spacing between the respective front and rear channels 80 and 82 is greater than the initial axial spacing between outer mounting portions 44 and 54 of the respective mounting rings 40 and 50 when mounted to the horn antenna 30. Accordingly, these outer mounting portions must be moved axially outwardly as indicated in phantom line in FIG. 5 to engage the channels 80, 82. This results in an axial offset between the respective inner and outer mounting portions 42 and 44 which is considerably less than the initial axial offset thereof, as indicated in solid line in FIG. 5. Hence, the flexible joining members or portions 46 are greatly resiliently deformed to define a much sharper, generally S-shaped curvature in cross-section, as also indicated in phantom line in FIG. 5.

Each of the mounting channels 80 and 82 is defined by a pair of axially spaced raised ridges 84, 86 which extend interiorly of the housing. The spacing between these ridges 84 and 86 is generally similar to the widths of outer mounting portions 44, 54 so as to receive outer mounting portions 44, 54 therebetween. Hence, these ridges and the opposing sides 44*a*, 44*b*, for example of outer mounting portion 44, comprise cooperating axial stop surfaces for preventing axial movement of the outer mounting portions relative to the channels 80, 82. Moreover, and as best viewed in FIG. 2, the inner and mounting rings further preferably include oppositely outwardly extending locating tabs or radial stop means 47 and 57, only one of each of these pairs of oppositely outwardly extending tabs being visible in the view of FIG. 2. These tabs engage facing surfaces of cooperating complementary notches or undercuts 88, 89 provided in the housing 20. Since the housing halves are substantially identical and symmetrical, it will be appreciated substantially one-half of the radial stop means or undercuts 88, 89 is provided in each of upper and lower housing halves 20*a* for receiving tabs 47 and 57. This structure then provides cooperating radial stop means for substantially preventing rotational movement of the outer mounting portions relative to the channels 80, 82.

As best viewed in FIG. 5, each of the vibration isolation mounting rings preferably is formed in a unitary fashion from a rubber or rubber-like material. This material is molded or otherwise formed into a generally shallow S-shaped curvature with enlarged, generally annular opposite end portions, to thereby form the inner and outer mounting portions 42, 44 and 52, 54 respectively intermediate resilient joining portions 46, 56. Additionally, a pair of generally annular, metallic mounting rings 48, 49 and 58, 59 are molded, or adhesively bonded, respectively to radially inner surfaces of both mounting portions 42, 44 and 52, 54. The outer one 49 of these additional annular metallic rings will be seen to further enhance the generally press-type fit of outer mounting portions 44, 54 within the channels 80, 82 adding additional rigidity to the radially inner surfaces thereof for this purpose.

As mentioned, the two mounting rings 40, 50 are identical. Hence only ring 40 will be described in further detail with reference to FIG. 5, it being understood that these details apply to ring 50 also. With respect to the radially inner mounting portion metallic annular ring 48, this ring will be seen to have a generally flared or diverging portion 48*a*. This diverging portion 48*a* generally matches a flared-out lead in surface 92 of a horn flange ring 90 to which the inner mounting portion 42 is mounted. Preferably, the radially inner surface of metallic ring 48 and a radially outer surface portion 93, following lead-in surface 92 of horn flange ring 90, fit together in a substantially resilient, spring-like engagement. Hence, these cooperating surfaces experience generally spring-urged frictional engagement for substantially preventing relative rotation therebetwen.

In this regard, the horn flange ring 90 will be seen to be mounted to a front flange or shoulder portion 100 of the horn 30. A cooperative generally L-shaped or annular radially outwardly extending portion 94 of flange ring 90 engages this lip or shoulder 100. A lens member 102 and a front prorective cover member 104 held in a generally annular frame 106 are further coupled over the open mouth of the horn 30 and against a leading edge 108 thereof by a threaded fastener 110. This fastener 110 extends through a receiving through aperture 112 in the front protective frame member 106 and into a complementary threaded aperture 112 provided therefor in the horn flange ring 90. The lens 102 is interposed intermediate the edge surface 108 of the horn 30 and a facing edge 114 f the frame member 106. Hence, a front portion of the horn 30 is effectively wedged or held between the horn flange ring 90 and the front frame assembly or member 106, substantially preventing either axial or rotational movement of any of these elements relative to each other.

Accordingly, the above-described radial stop tabs and cooperating notches 47, 57 and 88, 89 of the resilient mounting ring 40 and housing 20 effectively prevent any rotation of horn 30 relative to housing 20 upon assembly of the above-described structure. Hence, the horn flange ring 90 comprises a substantially rigid front mounting member defining generally cylindrical mounting surfaces of complementary configuration for receiving the inner mounting portion of the front vibration isolation mounting ring closely engaged thereabout.

Figure 9:
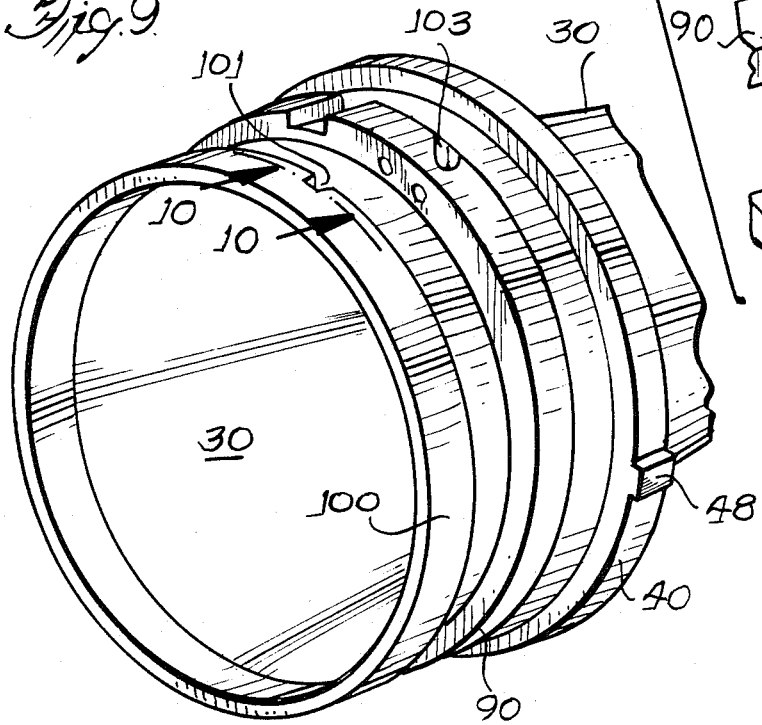
FIG. 9 is an enlarged partial perspective view illustrating details of an arrangement for controlling relative rotational orientation of parts of the assembly of the invention.
Figure 10:
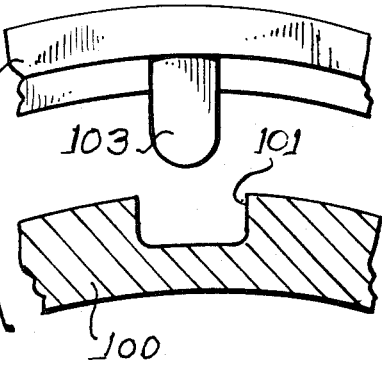
FIG. 10 is a further enlarged partial view taken generally in the plane of the line 10—10 of FIG. 9.

Referring briefly to FIGS. 9 and 10, the front and/or flange portion 100 of the horn 30 and the flange mounting ring 90 have further cooperating surfaces thereon for additionally holding the horn in predetermined rotational orientation relative to the flange mounting ring. In this regard, as best seen in FIGS. 9 and 10, a rear surface portion of horn flange 100 has an additional notch or cutout portion 101 formed therein which interfits in a complementary fashion with a corresponding internally extending boss or tab 103 formed on an interior surface of the horn flange ring. Preferably a second such cooperating tab and cutout or notch are also formed at portions of the horn flange 100 and flange ring 90 substantially 180 degrees removed from the like cooperating members illustrated in FIG. 9.

Figure 6:
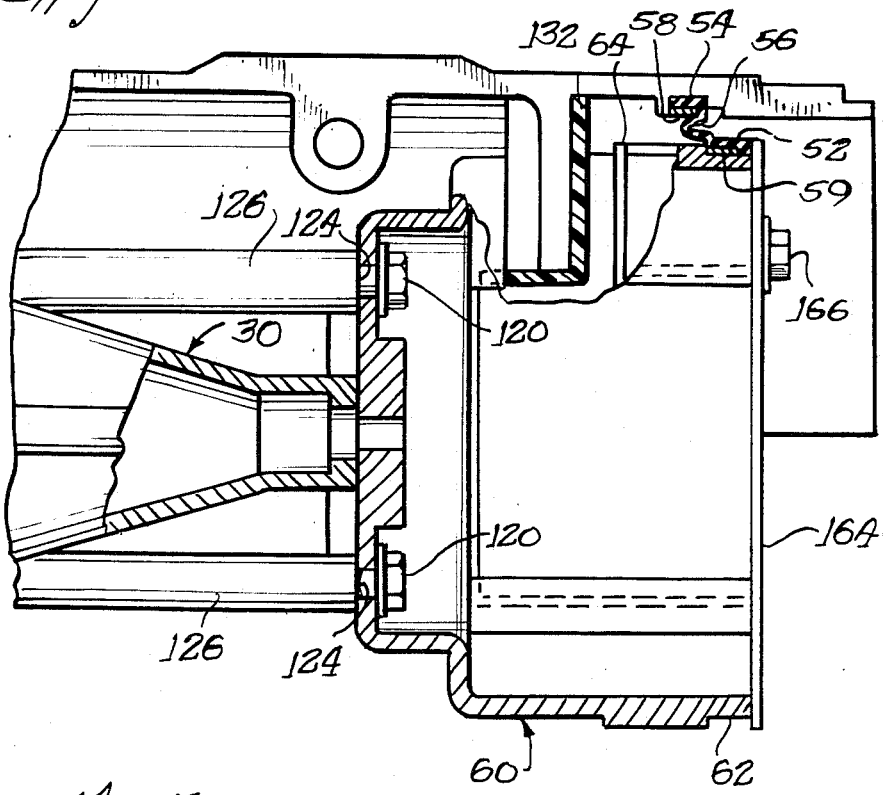
FIG. 6 is a partial sectional view, similar to FIG. 4, illustrating further details thereof.
Figure 8:
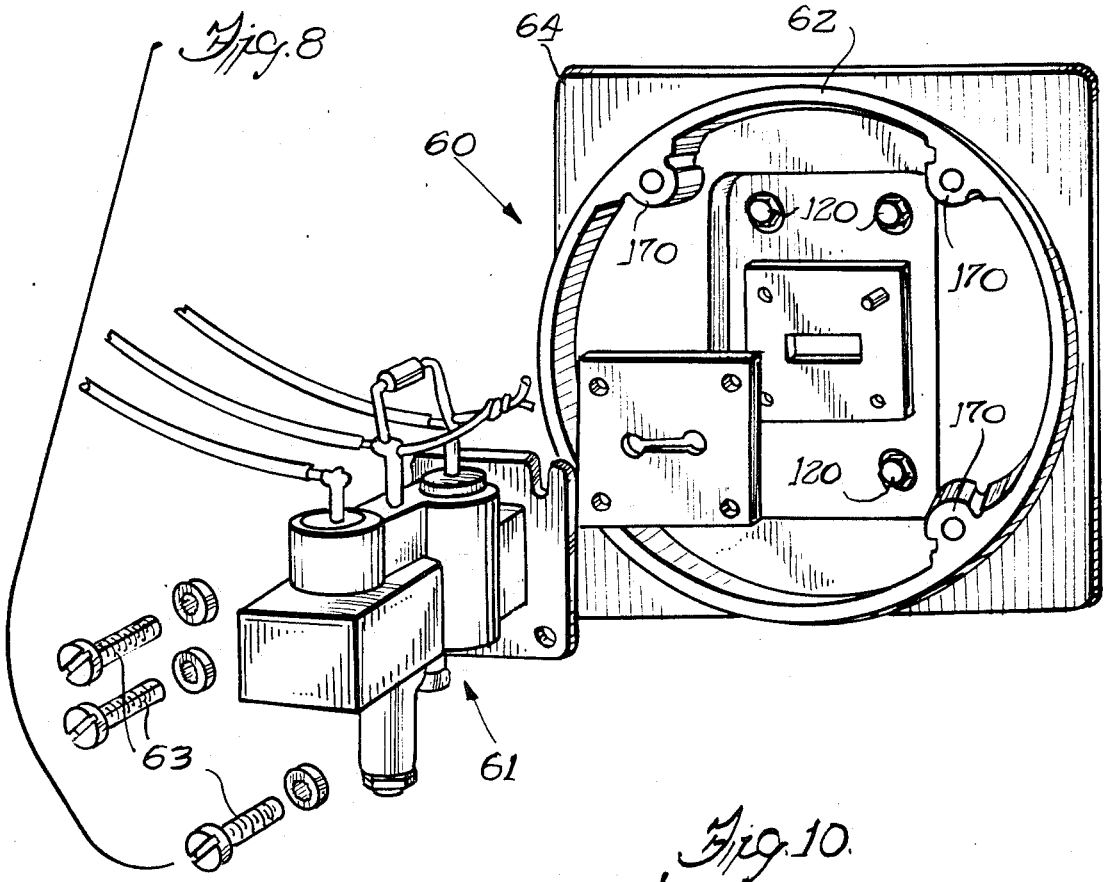
FIG. 8 is an enlarged exploded perspective view illustrating details of a further EMI/RFI shielded enclosure portion of the assembly of FIG. 1.

Referring now also to the rear mounting arrangement as best viewed in FIGS. 4 and 6, it will be seen that the transceiver housing 60 comprises a rigid member which is rigidly coupled with a rear end of the horn antenna 30. Preferably this coupling is done by a plurality of screw-type fasteners 120 (as also seen in FIG. 8) which engage complementary threaded apertures 124 provided in respectively radially outwardly extending mounting extensions or portions 126 formed toward a rear end portion of the horn 30. Moreover, the transceiver housing 60 includes a generally cylindrical outer surface portion 62 for receiving the inner mounting portion 52 of isolation mounting ring 50 in a relatively close, generally spring-urged or spring-loaded fit thereabout, generally in the same fashion as described above with reference to the mounting of inner mounting portion 42 of mounting ring 40 with respect to the horn flange ring 90. Hence, this frictional or spring-urged engagement substantialy prevents rotation of the inner mounting portion 52 relative to transceiver housing 60 and hence relative to horn 30 which is rigidly coupled therewith.

Moreover, transceiver housing 60 will be seen to further include a generally rectangular or square axially outwardly extending skirt or flange portion 64. This flange portion 64, while generally held (by mounting rings 40, 50) spaced apart from respective interior walls of the housing 20, provides additional guide or locating means for properly orienting the horn assembly portion, including the horn 30, transceiver housing 60, front and rear isolation mounting rings 40 and 50, flange ring 90 lens 102 and cover 106 relative to the housing halves **20*a* and 20*b***.

In accordance with another feature of the preferred embodiment illustrated, respective front and rear cushion means 130, 132 are also located at axially spaced apart locations on the housing. The front cushion means or member 130 is generally arcuate in form and preferably formed of a relatively resilient rubber-like material. The rear cushion means or members comprise two similar, relatively short wedge-like members, preferably also of a resilient rubber-like material.

As best viewed in FIG. 2, these front and rear cushion means or members 130 and 132 are shown in connection with the lower housing half **20*b* to which they are affixed, immediately axially inside of the respective mounting channels 88 and 89. It will be understood that similar cushion members are also preferably affixed in corresponding locations with respect to the upper housing half 20*a*. These cushions define axial movement iimiting abutting surfaces for abutment with cooperating axial abutment surfaces of the inner mounting members, namely, horn flange ring 90 and transceiver housing 60, for limiting axial movement of the horn antenna relative to the housing. In this regard, as best viewed in FIG. 5, it will be seen that a rear surface or axial end part 95 of peripheral wall 93 of horn flange ring 90 will be permitted only limited axial movement prior to abutment with a facing surface of front cushion member 130. Similarly, and referring to FIGS. 4 and 6, it will be seen that flange 64 of transceiver housing 60 is likewise permitted only a limited amount of axial movement before abutment with rear cushion member 132**.

Accordingly, the flange ring 90 defines a relatively rigid front mounting member having a generally cylindrical mounting surface 93 of complementary configuration for receiving the inner mounting portion 42 closely engaged thereabout, and extending therethrough to further define axial end part or surface 95 for abutment with front cushion 130. Similarly, the transceiver housing 60 also defines a rigid rear mounting member or portion 62 of generally cylindrical configuration for receiving the inner mounting portion 52 of the rear vibration isolation mounting ring closely engaged tnereabout and also defines thereon the outwardly extending flange 64 for defining a complementary abutment surface for limiting axial movement in cooperation with rear cushion member 132.

Figure 3:
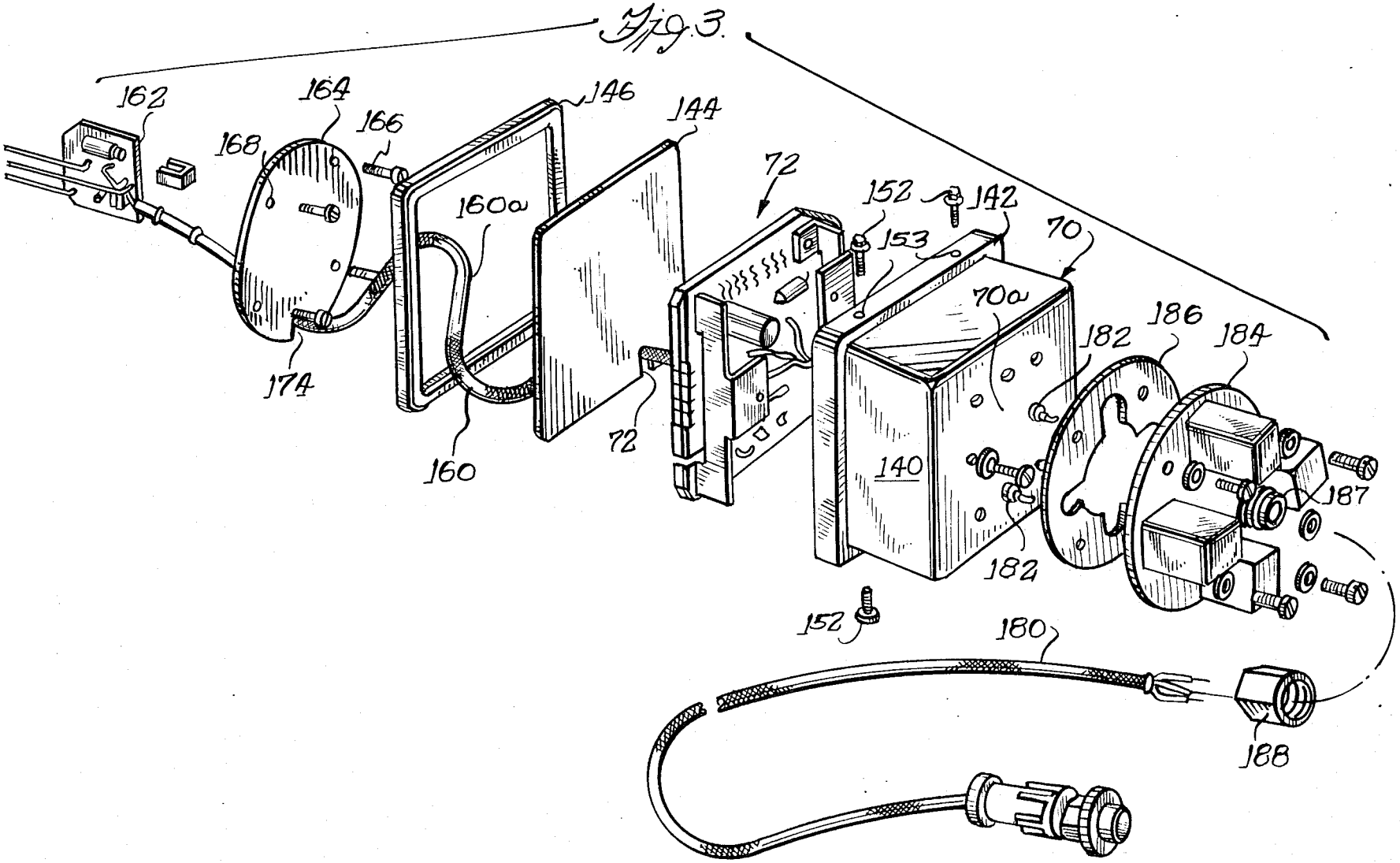
FIG. 3 is an exploded perspective view of a further portion of the radar unit assembly of FIG. 1.
Figure 7:
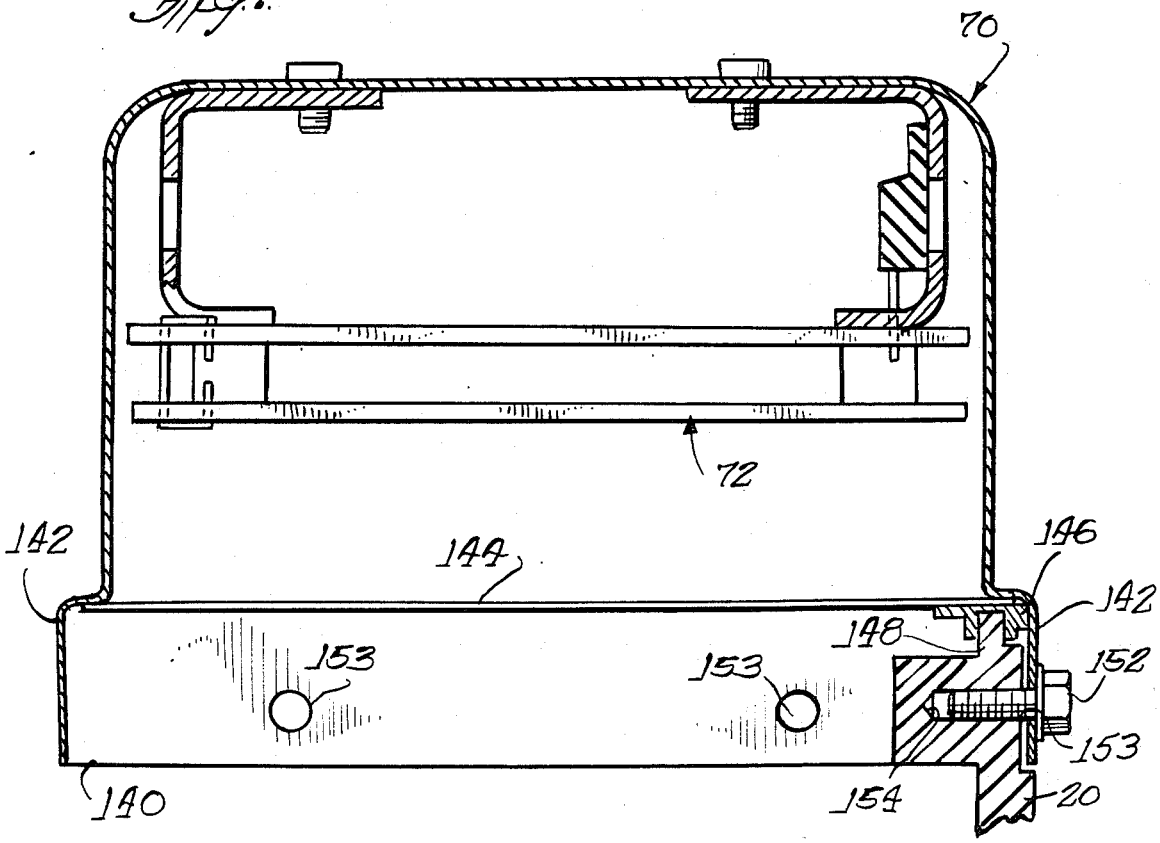
FIG. 7 is an enlarged sectional view illustrating details of an EMI/RFI shielded enclosure portion of the assembly of FIG. 1.

Referring now also to FIG. 3, the enclosure 10 further includes an EMI/RFI shielded enclosure 70, as previously mentioned, for enclosing electrical or electronic circuit means 72 operatively coupled with the horn antenna. This shielded enclosure 70 is preferably mounted to a rear end portion of the housing 20 to form a rear cover or closure therefor. In this regard, reference is also invited to FIG. 7, wherein further details of the mounting of enclosure 72 relative to housing 20 are illustrated.

In this regard, the shielded enclosure 70 is a generally continuously formed and preferably rectangular, hollow, cup-like enclosure member having one open side or face 140. This side or face 140 is defined at a generally radially outwardly extending flange portion 142 at an outer end of the enclosure member 70. In order to form an EMI/RFI shielded enclosure, a metallic closure plate 144 of complementary configuration to the open face 140 is introduced on and abutting a peripheral edge portion of the open face in metal-to-metal contact.

In particular, it will be seen that the edges of plate 144 abut the inner surface of shoulder portion 142.

In order to hold the plate 144 in intimate metal-to-metal contact with shoulder 142, a resilient compressible gasket member 146 is provided intermediate the outer surface or face of plate 144 and the outer rear edge 148 of the housing 120. As best viewed in FIG. 7 this gasket is generally U-shaped in cross-section for interfitting about this housing rear edge 148. Additionally, fastener means comprising screw-type threaded fasteners 152 extend through openings of 153 in side surfaces of the flange portion 142 and into complementary threaded bosses 154 provided in the housing 20. The securement by these fasteners of enclosure 70 to the rear end of housing 20 thereby urges the closure plate 144 against the peripheral edge or shoulder portion 142.

Advantageously, it will be seen that when the horn assembly is assembled with the housing in the fashion described, the vibration isolation rings 40, 50 also act as seals. That is, due to the resilient, rubber-like nature of these rings and their close engagement with portions of the horn assembly on the radially inner sides thereof and the housing on the radially outer sides thereof, tnese rings form a seal at either axial end of the housing 20. This seal is such as to generally prevent the ingress of dust, dirt, moisture of the like into the housing 20 and the horn housed there within. The seal 146 performs a similar function with respect to the EMI/RFI shielded enclosure member 70.

As best viewed in FIG. 3, a cable means, preferably comprising a woven metal-shielded cable 160 is utilized to carry conductors from the circuit 72 to a second electrical circuit portion 162 which is associated with the transceiver element 61 and preferably mounted in transceiver housing 60 therewith as indicated for example in FIG. 4. In this regard, the otherwise open rear end face of transceiver housing 60 is covered by a complementary circular metallic plate or cover member 164 which is preferably affixed thereto by means of screw-type fasteners 166 which extend through suitable through apertures 168 therein and engage complementary threaded bosses 170 (see also FIG. 8) in the interior of transceiver housing 60. Accordingly, both enclosure plate 144 and plate 164 have respective through openings 172 and 174 of generally complementary shape for receiving the cable therethrough in close engagement with the exterior woven metallic material shielding thereof.

Moreover, the flange or shoulder portion 142 of the EMI/RFI shielded enclosure 70, as well as a portion of housing 20 intermediate the plates 164 and 144 accommodate an extra length or portion of cable 160. This extra length of cable 160 is preferably formed into a generally spiral configuration as generally indicated at 160*a* in FIG. 3, for thereby substantially minimizing the transmission of any vibration across this space by the cable 160.

In order to further electrically isolate circuit 72 from externally generated radio frequency or electromagnetic radiation, all external wires utilized to transmit signals thereto or receive signals therefrom are fed through by way of a further, similar shielded cable 180. Moreover, the conductors from the shielded cable do not directly enter the enclosure 70, but rather are fed therethrough by means of a corresponding plurality of respective feed-through capacitors 182 which are configured to pass signals from the wires of cable 180 directly therethrough while providing capacitors of a value selected to substantially shunt unwanted frequency signals to ground. These feed through capacitors 182 are inserted through a rear wall 70*a* of the enclosure 70.

Moreover, an additional environmental shielding cover member 184 is joined in with the rear surface 70*a* of enclosure 70 by means of an intervening gasket member 186. This further shielding cover 184 is configured with suitable hollow embossments or portions to accommodate the protruding ends of the feed-through capacitors 182 therein. This further cover member 184 also includes a substantially centrally located sealable through opening 187 for receiving the cable 180 therethrough This opening 187 is preferably externally threaded to receive a complementary internally threaded nut-like sealing member 188 or ferrule which is configured to closely engage the external woven shielding of 180.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A vibration isolation enclosure for a horn antenna having a front end and a rear end, comprising: an elongate hollow housing defining a longitudinal axis and of sufficient dimensions to receive said horn antenna therewithin; respective front and rear vibration isolation mounting rings, each ring having a generally annular radially outer mounting portion and a generally annular radially inner mounting portion with respect to said axis and resilient vibration damping means between said inner and outer mounting portions; said radially outer mounting portions being mounted to said housing for orienting said vibration isolation mounting rings in a parallel, axially spaced apart condition with respect to said axis; and inner mounting means for mounting said inner mounting portions to said horn antenna in parallel, axially spaced condition, thereby placing said vibration damping means intermediate said horn antenna and said housing for opposing the transmission of vibrational forces in both axial and radial directions, with respect to said axis, therebetween; wherein said resilient vibration damping means comprise generally annular resilient flexible members joining said inner and outer mounting portions in such a way as to hold said inner and outer mounting portions at an initial axially offset, non-concentric condition; and wherein said horn antenna and said housing include respective portions for mounting said inner and outer mounting portions respectively axially offset by amounts considerably less than said initial axially offset condition for thereby greatly resilient deforming said flexible members into a condition wherein the inner and outer mounting portions are oriented more closely to a concentric orientation thereof and wherein said flexible members define a generally S-shaped curvature in cross-section; and further including front and rear cushion means locatable at axially spaced apart locations on said housing for defining axial movement limiting abutting for abutment with predetermined cooperating axial abutment surfaces surfaces for thereby limiting axial movement of said horn antenna relative to said housing; and further including a flange mounting ring conprising a portion of said inner mounting means coupled with said front end of said horn antenna and having a first annular peripheral wall extending through and engaging said inner annular mounting portion of said front vibration isolation mounting ring, an axial end part of said first annular peripheral wall forming one of said abutment surfaces for abutting said front cushion means.

2. A vibration isolation enclosure for a horn antenna having a front end comprising an open radiating aperture and a rear end, said enclosure comprising: an enlongate hollow housing defining a longitudinal axis between the ends thereof and of sufficient dimensions to receive said horn antenna therewithin; respective front and rear vibration isolation mounting rings, each ring having a generally annular radially outer mounting portion and a generally annular radially inner mounting portion with respect to said axis and resilient vibration damping means between said inner and outer mounting portion; said radially outer mounting portions being mounted to said housing for orienting said vibration isolation mounting rings in a parallel, axially spaced apart condition with respect to said axis; and inner mounting means for mounting said inner mounting portions to said horn antenna in parallel, axially spaced condition, thereby placing said vibration damping means intermediate said horn antenna and said housing for opposing the transmission of vibrational forces in both axial and radial directions, with respect to said axis, therebetween; wherein said each resilient vibration damping means comprise generally annular resilient flexible members joining said inner and outer mounting portions in such a way as to hold said inner and outer mounting portions at an initial axially offset, non-concentric condition; and wherein said horn antenna and said housing include respective portions for mounting said inner and outer mounting portions respectively axially offset by amounts considerably less than said initial axially offset condition for thereby greatly resiliently deforming said flexible members into a condition wherein the inner and outer mounting portions are oriented more closely to a concentric orientation thereof and wherein said flexible members define a generally S-shaped curvature axially in cross-section.

3. A vibration isolation enclosure according to claim 2 wherein said housing includes a pair of axially spaced mounting channels circumferentially oriented about respective front and rear ends of the housing, said channels including radial stop means and axial stop means for abutting cooperating axial and radial stop surfaces of said outer mounting portions of said vibration isolation mounting rings to substantially prevent axial or rotational movement of said outer mounting poritons relative to said channels.

4. A vibration isolation enclosure according to claim 3 and further including cooperating radial stop means coupled with said horn antenna and on said inner mounting portions for substantially preventing rotation therebetween.

5. A vibration isolation enclosure according to claim 1 and further including front and rear cushion means locatable at axially spaced apart locations on said housing for defining axial movement limiting abutting surfaces for abutment with predetermined cooperating axial abutment surfaces for thereby limiting axial movement of said horn antenna relative to said housing.

6. A vibration isolation enclosure according to claim 5 and further including a transceiver housing member defining thereon a portion of said inner mounting means and coupled with a rear end of said horn antenna and having a cylindrical outer wall portion for extending through and engaging said annular inner mounting portion of said rear vibration isolation mounting ring and having a radially outwardly extending flange portion about said cylindrical wall portion for defining a further one of said abutment surfaces for abutting said rear cushion means.

7. A vibration isolation enclosure according to claim 6 wherein said transceiver housing comprises a metallic, enclosed member for defining an EMI/RFI shielded enclosure for a transceiver element operatively coupled with said horn antenna.

8. A vibration isolation enclosure according to claim 1 wherein said inner mounting means comprise a rigid front mounting member coupled with said front end of said horn and a rigid rear mounting member coupled with said rear end of said horn antenna, said front and rear rigid mounting members defining generally cylindrical mounting surfaces of complementary configuration for receiving the respective inner mounting portions of said vibration isolation mounting rings closely engaged thereabout.

9. A vibration isolation enclosure according to claim 2 wherein said housing includes front and rear parts of spaced apart raised ridges formed interiorly thereof, for receiving said annular outer mounting portions of said front and rear vibration isolation mounting rings respectively therebetween.

10. A vibration isolation enclosure according to claim 2 and further including EMI/RFI shielded enclosure means for enclosing electrical circuit means, said electrical circuit means to be operatively coupled with said horn antenna, said shielded enclosure means being mounted to said housing to form a rear closure for said housing.

11. A vibration isolation enclosure according to claim 2 and further including a horn flange ring comprising a portion of said inner mounting means coupled with said front end of said horn antenna, and wherein said front end portion of said horn antenna and said horn flange ring include cooperating surfaces thereon for holding said horn in a predetermined rotational orientation relative to said horn flange ring.

12. A vibration isolation enclosure according to claim 11 wherein said horn flange ring and said front isolation mounting ring have cooperating interfitting surfaces thereon for holding said front isolation mounting ring in a predetermined rotational orientation relative to said flange mounting ring.

13. A vibration isolation enclosure according to claim 12 wherein said front isolation mounting ring and said housing have cooperating interengageable surfaces for maintaining said front isolation mounting ring in a predetermined angular orientation and against rotation relative to said housing.

14. A vibration isolation enclosure according to claim 2 and further including a transceiver housing member coupled to said rear end of said horn antenna and defining a portion of said inner mounting means and wherein said transceiver housing and said rear isolation mounting ring include cooperating interfitting surfaces thereon for holding said transceiver housing in a predetermined rotational orientation relative to said rear isolation mounting ring.

15. A vibration isolation enclosure according to claim 14 wherein said rear isolation mounting ring and said housing have cooperating interengageable surfaces for maintaining said rear isolation mounting ring in a predetermined angular orientation relative to said housing.

16. A vibration isolation enclosure according to claim 2 wherein said housing defines two sets of mounting bores thereon for receiving mounting hardware therethrough, said two sets of mounting bores being oriented substantially at right angles to each other for mounting said housing to a desired surface.

17. A vibration isolation enclosure for a horn antenna having a front and a rear end, comprising: an elongate hollow housing defining a longitudinal axis and of sufficient dimensions to receive said horn antenna therewithin; respective front and rear vibration isolation mounting rings, each ring having a generally annular radially outer mounting portion and a generally annular radially inner mounting portion with respect to said axis and resilient vibration damping means between said inner and outer mounting portions; said radially outer mounting portions being mounted to said housing for orienting said vibration isolation mounting rings in a parallel, axially spaced apart condition with respect to said axis; and inner mounting means for mounting said inner mounting portions to said horn antenna in parallel, axially spaced condition, thereby placing said vibration damping means intermediate said horn antenna and said housing for opposing the transmission of vibrational forces in both axial and radial directions, with respect to said axis, therebetween; wherein said resilient vibration damping means comprise generally annular resilient flexible members joining said inner and outer mounting portions in such a way as to hold said inner and outer mounting portions at an initial axially offset, non-concentric condition; and wherein said horn antenna and said housing include respective portions for mounting said inner and outer mounting portions respectively axially offset by amounts considerably less than said initial axially offset condition for thereby greatly resiliently deforming said flexible members into a condition wherein the inner and outer mounting portions are oriented more closely to a concentric orientation thereof and wherein said flexible members define a generally S-shaped curvature in cross-section; and furtner including EMI/RFI shielded encloure means for enclosing electrical circuit means, said electrical circuit means to be operatively coupled with said horn antenna, said shielded enclosure means being mounted to said housing to form a rear closure for said housing and wherein said shielded enclosure means comprises a continuous metallic walled enclosure member having an open side, flange means about said open side of said enclosure member for closely surroundingly engaging an outer end portion of the outer surface of said housing; a metallic closure plate of complementary configuration for covering said enclosure open side; and resilient means for pressing said closure plate against a peripheral edge portion of said open side in metal-to-metal contact.

18. A vibration isolation enclosure according to claim 17 wherein said resilient means comprises a resilient compressible gasket member for interfitting intermediate an outer end surface of said housing and said closure plate and fastener means joining said housing and said shielded enclosure so as to urge said gasket member against said closure plate and said closure plate against said peripheral edge portion of said open side.

19. A vibration isolation enclosure according to claim 11 and further including cable means coupled intermediate said electrical circuit means and said horn antenna, said closure plate having a through opening for receiving said cable therethrough in close engagement therewith, and said housing defining a space intermediate said closure plate and said shielded enclosure means; said cable being formed into a spiral configuration in said space for substantially minimizing the transmission of vibration to said housing by said cable.

20. A vibration isolation enclosure for a horn antenna having a front end and a rear end, comprising: an elongate hollow housing defining a longitudinal axis and of sufficient dimensions to receive said horn antenna therewithin; respective front and rear vibration isolation mounting rings, each ring having a generally annular radialy inner mounting portion and a generally annular radially inner mounting portion with respect to said axis and resilient vibration damping means between said inner and outer mounting portions; said radially outer mounting portions being mounted to said housing for orienting said vibration isolation mounting rings in a parallel, axially spaced apart condition with respect to said axis; and inner mounting means for mounting said inner mounting portions to said horn antenna in parallel, axially spaced condition, thereby placing said vibration damping means intermediate said horn antenna and said housing for opposing the transmission of vibrational forces in both axial and radial directions, with respect to said axis, therebetween; wherein said resilient vibration damping means comprise generally annular resilient flexible members joining said inner and outer mounting portions at an initial axially offset, non-concentric condition; and wherein said horn antenna and said housing include respective portions for mounting said inner and outer by amounts considerably less than said initial axially offset mounting portions respectively axially offset condition for thereby greatly resiliently deforming said flexible members into a condition wherein the inner and outer mounting portions are oriented more closely to a concentric orientation thereof and wherein said flexible members define a generally S-shaped curvature in cross-section; and further including EMI/RFI shielded enclosure means for enclosing electrical circuit means, said electrial circuit means to be operatively coupled with said horn antenna, said shielded enclosure means being mounted to said housing to form a rear closure for said houisng and further incluidng RF grounding feed through capacitors inserted through a wall of said shielded enlosure means form feeding all signals to be received and transmitted by said circuit means fron and to external wires therethrough.

21. A vibration isolation enclosure according to claim 20 and further including a further RFI/EMI shielding cover member joined in metal-to-metal contact with said enclosure and configured for covering protruding terminals of said feed through capacitors and having a sealable end opening for receiving said external wires therethrough.

* * * * *